US006126510A

United States Patent [19]

Weiss, Jr.

[11] Patent Number: 6,126,510

[45] **Date of Patent: *Oct. 3, 2000**

[54] BOUNCING TOY

[76] Inventor: Andrew M. Weiss, Jr., 220 E. 63rd St., New York, N.Y. 10021

[ * ] Notice: This patent issued on a continued prosecution application filed under 37 CFR 1.53(d), and is subject to the twenty year patent term provisions of 35 U.S.C. 154(a)(2).

[21] Appl. No.: 08/838,843

[22] Filed: Apr. 11, 1997

[51] Int. Cl.[7] ..... A63H 33/00

[52] U.S. Cl. ..... 446/486; 446/486; 446/431; 446/437; 446/226

[58] Field of Search ..... 446/486, 431, 446/437, 226, 223, 220, 369, 325; 473/595, 606, 600

[56] References Cited

U.S. PATENT DOCUMENTS

| | | | |
|---|---|---|---|
| 790,660 | 5/1905 | Prior | 446/325 |
| 1,064,051 | 6/1913 | Buckler | 446/369 |
| 1,558,200 | 10/1925 | Murphy | 446/226 X |
| 2,217,434 | 10/1940 | Dorn | 473/600 |
| 2,685,758 | 8/1954 | Ochs | 446/223 |
| 4,003,573 | 1/1977 | Craig Jr. | 473/595 |
| 4,439,471 | 3/1984 | Lacoste et al. | 473/606 X |
| 4,725,058 | 2/1988 | Molitor | 473/600 |
| 5,048,829 | 9/1991 | Propupek | 473/595 |
| 5,131,665 | 7/1992 | Myers | 473/600 |
| 5,496,026 | 3/1996 | Montgomery | 473/600 X |
| 5,649,875 | 7/1997 | Spector | 446/226 X |

FOREIGN PATENT DOCUMENTS

| | | | |
|---|---|---|---|
| 448568 | 8/1927 | Germany | 446/226 |
| 141648 | 4/1920 | United Kingdom | 446/369 |

*Primary Examiner*—D. Neal Muir
*Attorney, Agent, or Firm*—Wechsler & Wechsler, P.C.; Lawrence I. Wechsler

[57] ABSTRACT

A shaped toy includes a kinetically resilient central core and an outer layer of varying thickness covering the central core. The outer layer may be a material which also exhibits kinetic resiliency, to a degree more or less than that of the core, or, alternatively, be substantially non-resilient, such as fabric or pile. In a preferred embodiment, the toy includes a substantially spherically shaped core, covered by an outer layer of fabric, the type used for fabrication of conventional plush stuffed toys, increasing its appeal, by virtue of appearance and feel, to user and animal alike. The fabric, when stitched together using conventional stuffed animal sewing techniques, encloses the resilient central core, and presents regions of varying thickness over an expanse thereof, such that when thrown against a surface, unpredictable direction and bounce response will result by virtue irregular surface curvature and damping due to increasing and decreasing fabric thickness. Optionally, a length of fabric, other outer layer material, or another material altogether may be fashioned to extend from the toy, facilitating throwing and grabbing thereof by providing a "tail" by which the rest of the toy can be swung.

21 Claims, 2 Drawing Sheets

BOUNCING TOY

BACKGROUND OF THE INVENTION

The present invention relates to a toy for providing entertainment to adults, children, and/or animal companions, and more particularly a toy which bounces in an unpredictable manner when made to strike a resisting surface, such as the ground or a wall.

Balls capable of bouncing have long been popular as a source of entertainment for children and adults alike, and their animal companions, and as such have been produced in a myriad of sizes and designs, ranging for example from ping pong balls to basket balls. A wide variety of materials have been used to fabricate the many different balls, including hard plastic, hollow rubber, rubber or urethane foam, polyethylene foam, vinyl, etc. Some, such as tennis balls, are of layered construction, and include an airtight pressurized core providing kinetic resiliency, and a felt-like material outer covering.

Generally, it is desirable for such a ball as described above to bounce in a predictable manner, since in most cases it is used in a game in which the ball is retrieved or returned to an opponent. As a consequence, most balls available heretofore have been designed to be substantially spherical, presenting an even, regular surface.

In certain instances, however, it might be desirable to provide a toy which departs from bounce predictability, for adult and child user entertainment, and for play with animals, such as dogs or cats. The prior art has not adequately addressed this need.

OBJECTS AND SUMMARY OF THE INVENTION

Accordingly, it is an object of the invention to provide a bouncing toy which overcomes the drawbacks of the prior art.

It is a further object of the invention to provide a bouncing toy adapted to multiple embodiments providing amusement to a user of same and/or the user's pet by providing an unpredictable bounce path following forcible striking against a resisting surface.

It is a still further object of the invention to provide a bouncing toy in a form adapted to fabrication in animal or other character representation for enhanced user appeal.

It is yet a further object of the invention to provide a bouncing toy which may be fabricated using conventional techniques for a finished product which is both attractive and economical.

Briefly stated, there is provided a shaped toy which includes a kinetically resilient central core and an outer layer of varying thickness covering said central core. For purposes herein, "kinetic resiliency" or "kinetically resilient" is defined as a property of a material, or an object shaped or fabricated therefrom, resulting in bounce when same is caused to strike a resisting (deflecting) surface. A "resisting surface" or "deflecting surface" is any surface presented by a structure having sufficient mass to deflect the trajectory of the toy when throw thereagainst, and may include a floor, the ground, walls, a backboard, or other like stationary surface, and may further include a moving target having sufficient mass or securement. The outer layer may be comprised of a material which also exhibits kinetic resiliency, to a degree more or less than that of the core, or, alternatively, be substantially non-resilient, such as fabric or pile.

In an embodiment in accordance with the invention, a toy is provided that includes a kinetically resilient central core, advantageously comprised of a shaped mass of elastomeric foam, such as foamed polyurethane or polyethylene. The core, which advantageously is also substantially spherical in shape, is covered by an outer layer presenting varying thickness over an expanse thereof. In the embodiment, the outer layer is a fabric, advantageously of the type used for fabrication of conventional plush stuffed toys, increasing its appeal, by virtue of appearance and feel, to user and animal alike. The fabric, when stitched together using conventional stuffed animal sewing techniques, encloses the resilient central core, and presents regions of varying thickness over an expanse thereof, such that when thrown against a surface, unpredictable direction and bounce responses (intensity) result by virtue irregular surface curvature and damping due to increasing and decreasing fabric thickness. Optionally, a length of fabric, other outer layer material, or another material altogether may be fashioned to extend from the toy, facilitating throwing and grabbing thereof by providing a "tail" by which the rest of the toy can be swung.

In an advantageous embodiment, the toy as described in the preceding embodiment is further fashioned to resemble an animate subject, including, for example, a character or animal, or other non-arbitrary representation (such as for example an inanimate article). When so fashioned for example as an animal, the various features thereof, for example eyes, ears, nose, etc. themselves comprise areas of varying outer layer thickness, the animal's head and body conveniently approximated by a somewhat spherical configuration defined by a like-shaped central core. Optionally, the outer layer may further include extending appendages resembling, for example, limbs in the case of an animal embodiment, which are structurally equivalent to the "tail" described above.

A method is also described for user entertainment alone or during interplay activities with a pet, such as a dog. In practicing the method, the toy as described herein, for example, in accordance with the above embodiments, is thrown by the user against a deflecting surface with the intention of imparting an unpredictable bounce path.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

The present invention is directed generally to a shaped toy which includes a kinetically resilient central core and an outer layer of varying thickness covering said central core. As defined herein, "kinetic resiliency" or "kinetically resilient" describes a property of a material, or an object shaped or fabricated therefrom, resulting in bounce when same is caused to strike a resisting surface. A "resisting surface" or "deflecting surface" is any surface presented by a structure having sufficient mass to deflect the trajectory of the toy when throw thereagainst, and may include a floor, the ground, walls, a backboard, or other like stationary surface, and may further include a moving target having sufficient mass or securement. In broadest terms, the outer layer may be comprised of a material which also exhibits kinetic resiliency, to a degree more or less than that of the core, or, alternatively, be substantially non-resilient, such as fabric or pile. It will be further understood that the outer layer may be comprised of more than one material, and presenting different properties about the shaped toy. Where non-resilient, the outer layer, at least over an area portion thereof, will not be so thick as to entirely damp the bounce-imparting effects of the resilient central core.

Figure 1:
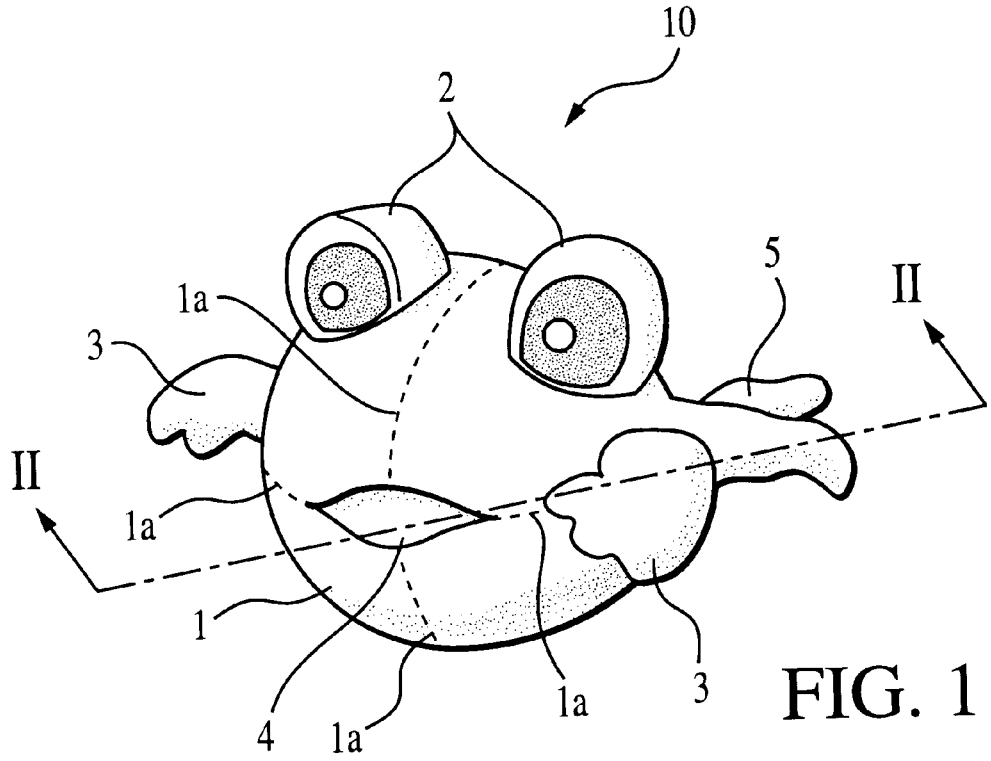
FIG. 1 is a perspective view of a toy in accordance with an embodiment of the invention.

Referring now to the figures, and in particular FIG. 1, an advantageous embodiment in accordance with the invention has been selected for disclosure of the invention, and in which a toy, generally designated 10, takes the form of an animal representation, specifically in the present example, a frog. Toy 10 advantageously has a generally spherical, overall shape, approximating the frogs head and body, as shown. Toy 10 includes an outer layer 1, advantageously having a smooth, safe texture. Since plush fabric commonly used for conventionally produced stuffed animals appeals to people and animals by virtue of its pleasing appearance and feel, outer layer 1 is more preferably comprised substantially of plush fabric which is stitched together along seams 1*a* (preferably internally stitched) using conventional sewing practices. Regions of varying outer layer thickness are provided, conveniently and concomitantly with representation of the frog's features. For example, eyes 2 and forelimbs 3 protrude from toy 10, and create an uneven surface configuration. A mouth 4 is conveniently fashioned from another, thinner type of fabric (non-plush) and therefore toy 10 will experience less damping when struck against a support surface in that particular region. A tail 5, configured in the present frog embodiment to resemble hind legs, is fashioned conveniently from the same fabric as the outer layer, and extends from a body of toy 10, providing a handle, of sorts, by which to grab toy 10 while throwing and retrieving.

Figure 2:
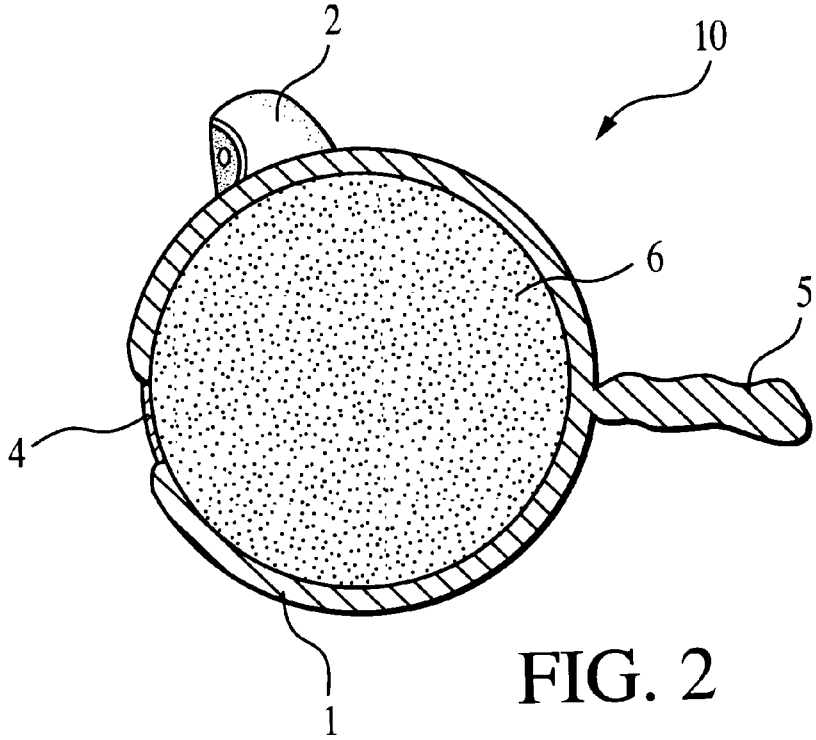
FIG. 2 is cross-sectional view of the toy depicted in FIG. 1 taken on line II—II.
Figure 3:
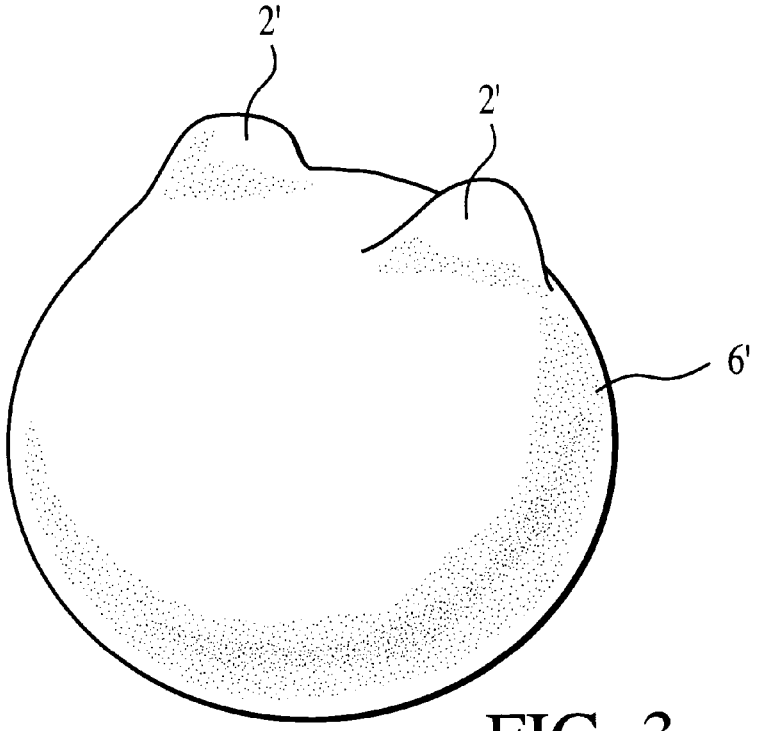
FIG. 3 is a perspective view of another embodiment of a central core having irregular protrusions.
Figure 4:
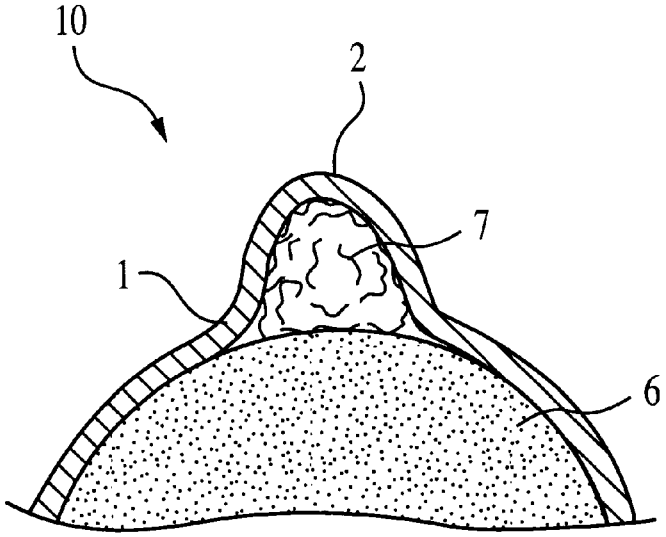
FIG. 4 is a partial cross-sectional view of the toy of FIG. 1 taken across a protruding eye region supported by stuffing between the core and the outer layer.

Turning now to FIG. 2, the toy of FIG. 1 shown in cross-section includes a central core 6. Central core 6 is made in any suitable shape, but is advantageously substantially spherical, for appearance and performance. As noted above, central core 6 includes means for providing kinetic resiliency to toy 10 in which it is included. This is conveniently and advantageously in the form of a shaped mass of polyurethane foam suitable for such elastomeric purposes. Although shown spherical, central core 6 may be made alternatively with irregular protrusions therealong, for example having extending portions 2' forming a resilient core for eyes 2, instead of having eyes 2 which contain non-resilient stuffing, as generally practiced, as shown in FIG. 3 depicting such modified central core 6'. In addition, kinetically resilient shaped masses other than central core 6 may be variously placed below outer layer 1 to provide even greater bounce unpredictability. FIG. 4 depicts toy 10 of FIG. 1, in which the aforementioned general practice is employed, in which the eyes 2 are supported by stuffing 7 interposed in a region between central core 6 and the portion of outer layer 1 corresponding to the eyes 2. In the embodiment depicted in FIG. 4, the combination of stuffing 7 and outer layer 1 together comprise a fitted covering for central core 6.

In a method for use of a toy in accordance with an embodiment of the invention, the toy is thrown by the user against a deflecting surface with the intention of imparting an unpredictable bounce path, to provide user and/or animal entertainment.

Although described with specific reference to a toy resembling a frog, many other character representations are contemplated, such as pigs, dogs, monkeys, fish, birds, etc. In these alternate embodiments it will be understood that features other than the prominent eyes of the frog will provide thicker regions of the outer layer. For example, depending on the particular subject represented, it may be found more appropriate to have thicker material in regions representing the mouth and ears (monkey), snout (pig), beak (bird), etc.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A bouncing toy, comprising:

a central core consisting of a single kinetically resilient core member; and a covering fitted to said core member, said covering including at least an outermost layer of flexible material enclosing said core member and presenting an appearance representative of an animate subject, an outer surface of said outermost layer having an uneven configuration presenting varying thickness between said outer surface and a surface of said core member over area portions of said covering, at least one of said area portions corresponding to a feature of said animate subject, a portion of a force generated by an impact of said bouncing toy with a resisting surface being transmitted to said central core across a particular thickness of said outer covering at a point of impact in a varying amount depending upon an orientation of said bouncing toy relative said resisting surface resulting in unpredictable rebound.

2. A bouncing toy according to claim 1, wherein said core member is comprised of a solid mass of elastomeric foam.

3. A bouncing toy according to claim 1, wherein said core member is approximately spherical in shape.

4. A bouncing toy according to claim 1, wherein said core member is of a shape presenting irregular protrusions therefrom.

5. A bouncing toy according to claim 1, wherein said outermost layer is comprised of plush fabric.

6. A bouncing toy according to claim 1, wherein said outermost layer is comprised of a combination of plush and non-plush fabric.

7. A bouncing toy according to claim 1, further comprising a member attached to a remaining portion of said bouncing toy and extending therefrom for providing a means for facilitated grabbing of said bouncing toy.

8. A bouncing toy according to claim 1, further comprising a member attached to a remaining portion of said bouncing toy and extending therefrom for providing a means for facilitated grabbing of said bouncing toy.

9. A bouncing toy according to claim 1, wherein said covering further comprises at least one appendage fixed to a remainder of said bouncing toy and extending outwardly of said outermost layer.

10. A bouncing toy according to claim 1, wherein said covering further comprises stuffing interposed between said outermost layer and said core member in at least one area region of said bouncing toy.

11. A bouncing toy according to claim 10, wherein said at least one area region coincides with said at least one of said area portions corresponding to a feature of said animate subject.

12. A method for providing entertainment, comprising:

imparting velocity to a toy in a direction for impact against a resisting surface, said toy including a kinetically resilient central core consisting of a single core member, and a covering including a flexible outermost layer enveloping said central core and presenting an appearance representative of an animate subject, said covering presenting varying thickness over area portions thereof, at least one of said area portions corresponding to a feature of said animate subject, said toy rebounding from said resisting surface along an unpredictable deflection path dependent upon an particular orientation of said bouncing toy relative said resisting surface at a time of impact therewith.

13. A method according to claim 12, wherein:

said toy further comprises an elongated member attached to a remaining portion of said bouncing toy and extending therefrom; and said step of imparting velocity includes holding said elongated member, and swinging the toy prior to release in said direction for impact.

14. A method according to claim 12, wherein said core member is comprised of a solid mass of elastomeric foam.

15. A method according to claim 12, wherein said outermost layer is comprised of plush fabric.

16. A bouncing toy, comprising:

a kinetically resilient central core consisting of a single kinetically resilient core member; and an outer layer of flexible material enveloping said central core, said outer layer presenting at least three regions of different relative thickness positioned about said central core to be impactable with a planar resisting surface, bounded areas of said at least three regions having distinct shapes different from one another, a portion of a force generated by an impact of said bouncing toy with said resisting surface being transmitted to said central core across a particular thickness presented by a particular one of said at least three regions impacting with the resisting surface in a varying amount depending upon an orientation of said bouncing toy relative said resisting surface.

17. A bouncing toy according to claim 16, wherein said core member is comprised of a solid mass of elastomeric foam.

18. A bouncing toy according to claim 16, wherein said outer layer is comprised of plush fabric.

19. A bouncing toy according to claim 16, wherein said outer layer is fashioned to resemble an animate subject, at least one of said area portions corresponding to a feature of said animate subject.

20. A method for providing entertainment, comprising the steps of:

providing a toy including a kinetically resilient central core and an outer layer of flexible material enveloping said central core, said outer layer presenting at least three regions of different relative thickness positioned about said central core to be impactable with a planar resisting surface, bounded areas of said at least three regions having distinct shapes different from one another, a portion of a force generated by an impact of said bouncing toy with said resisting surface being transmitted to said central core across a particular thickness presented by a particular one of said at least three regions impacting with the resisting surface in a varying amount depending upon an orientation of said bouncing toy relative said resisting surface; and imparting velocity to said toy in a direction for impact against a resisting surface thereby effecting an unpredictable path of deflection following said impact.

21. A method according to claim 20, wherein said outer layer is fashioned to resemble an animate subject, at least one of said at least three regions corresponding to a feature of said animate subject.

* * * * *